US009803383B2

(12) United States Patent
Amon

(10) Patent No.: US 9,803,383 B2
(45) **Date of Patent: *Oct. 31, 2017**

(54) FORMWORK ANCHOR RECEPTACLE, A FORMWORK ANCHOR AS WELL AS A FORMWORK ELEMENT FOR RECEIVING THESE

(71) Applicant: Doka Industrie GmbH, Amstetten (AT)

(72) Inventor: Peter Amon, Amstetten (AT)

(73) Assignee: Doka Industrie GmbH, Amstetten (AT)

( * ) Notice: Subject to any disclaimer, the term of this patent is extended or adjusted under 35 U.S.C. 154(b) by 0 days.

This patent is subject to a terminal disclaimer.

(21) Appl. No.: 14/947,496

(22) Filed: Nov. 20, 2015

(65) Prior Publication Data

US 2016/0097207 A1 Apr. 7, 2016

Related U.S. Application Data

(63) Continuation of application No. 14/306,365, filed on Jun. 17, 2014, now Pat. No. 9,222,271.

(30) Foreign Application Priority Data

Jun. 19, 2013 (DE) ..... 10 2013 211 490

(51) Int. Cl.
*E04G 17/065* (2006.01)
*E04G 17/00* (2006.01)

(52) U.S. Cl.
CPC ..... *E04G 17/0652* (2013.01); *E04G 17/00* (2013.01)

(58) Field of Classification Search
CPC ..... E04G 17/06; E04G 17/065
USPC ..... 249/40, 190, 213, 216
See application file for complete search history.

(56) References Cited

U.S. PATENT DOCUMENTS

| | | | | |
|---|---|---|---|---|
| 2,116,597 | A | 5/1938 | Colt | |
| 2,172,461 | A | 9/1939 | Whitescarver | |
| 8,220,772 | B2 * | 7/2012 | Schwoerer | 249/40 |
| 8,464,997 | B2 | 6/2013 | Peneder | |
| 8,727,302 | B2 | 5/2014 | Braun et al. | |
| 2004/0079860 | A1 | 4/2004 | Ward et al. | |
| 2010/0059655 | A1 | 3/2010 | Schwoerer | |
| 2011/0200406 | A1 | 8/2011 | Lang et al. | |

FOREIGN PATENT DOCUMENTS

| | | |
|---|---|---|
| DE | 94 12 556 U1 | 10/1994 |
| DE | 10 2006 023 062 A1 | 11/2007 |
| DE | 10 2010 002 108 A1 | 8/2011 |
| DE | 10 2010 002 128 A1 | 8/2011 |
| DE | 10 2010 003 017 A1 | 9/2011 |

(Continued)

*Primary Examiner* — Michael Safavi
(74) *Attorney, Agent, or Firm* — Fitch, Even, Tabin & Flannery, LLP

(57) ABSTRACT

The present invention relates to a formwork anchor receptacle as well as to a formwork anchor which are used in the field of construction. Furthermore, the invention relates to a formwork element. The formwork anchor receptacle is adapted to receive an anchor rod provided to connect formwork elements. The formwork anchor receptacle comprises a section with an opening for insertion of an anchor rod and a spherical section for providing support against a formwork element.

23 Claims, 6 Drawing Sheets

(56) References Cited

FOREIGN PATENT DOCUMENTS

| | | | |
|---|---|---|---|
| DE | 10 2012 203 678 | A1 | 9/2013 |
| EP | 2 126 248 | A1 | 12/2000 |
| EP | 2 060 703 | A1 | 5/2009 |
| WO | 2008/089442 | A2 | 7/2008 |
| WO | 2008/089737 | A1 | 7/2008 |

* cited by examiner

FORMWORK ANCHOR RECEPTACLE, A FORMWORK ANCHOR AS WELL AS A FORMWORK ELEMENT FOR RECEIVING THESE

CROSS REFERENCE TO RELATED APPLICATIONS

This application is a continuation of prior application Ser. No. 14/306,365, filed Jun. 17, 2014, which claims priority from German Application DE 10 2013 211 490.7, filed Jun. 19, 2013, which is hereby incorporated herein by reference in its entirety.

TECHNICAL FIELD

The present invention relates to a formwork anchor receptacle as well as to a formwork anchor which are used in the field of construction. Formwork elements are positioned with a certain distance therebetween and are connected together by means of formwork anchors before the gap thus formed is filled with fill material. The formwork anchors are removed after the concrete has hardened such that the formwork elements can be detached from the wall thus formed in the subsequent step.

BACKGROUND

Known as prior art is a formwork anchor according to EP 2 060 703 A1, which is adapted to connect formwork elements in a tension-proof manner. This known formwork anchor is composed of several sections or elements, whereby the anchoring element can be freely displaced in the longitudinal direction relative to the second anchoring section and can be fixed at the engagement means.

Also known is DE 10 2010 002 108 A1 which reveals an anchoring system for a concrete wall form with at least one retaining device for an anchor rod of the anchoring system. The retaining device comprises an annular sealing member as well as a screw nut member for screwing in the anchor rod. Also provided is a waller plate which can be attached to a rear side of the formwork element of the concrete wall form by means of fasteners and which comprises a spherically shaped plate region with an opening in which the screw nut member is arranged with radial play.

SUMMARY

One object of the present invention is to provide a formwork anchor receptacle as well as a formwork anchor which make it possible to ensure the greatest possible uniformity of the anchor intervals on a formwork element whilst at the same time ensuring easy handling, and to thus reduce the amount of work required for setting up and connecting formwork elements.

This object is solved by a formwork anchor receptacle according to claim 1, a formwork anchor according to claim 6, as well as a formwork element according to claim 14. Further preferred embodiments can be seen from the dependent claims.

Within the scope of the present invention, a framework anchor receptacle is provided with a spherical section which is disposed in a support component of a formwork element and which allows the formwork anchor to be pivoted out of its normal orientation relative to the formwork element (for example by 4°).

According to the invention, the formwork anchor receptacle comprises a preferably cylindrical section having an opening for insertion of an anchor rod, and a spherical section for providing support against a formwork element.

Owing to the spherical design, misalignment between openings of opposite formwork elements which allow passage of anchors can be compensated by ensuring a certain deviation from the normal in relation to a formwork element. Despite this compensation, the formwork anchor receptacle and formwork anchor according to the invention still ensure solid anchoring of the formwork elements and a seal against the fill area formed between the formwork elements.

Furthermore, the design according to the invention ensures that a formwork anchor can be handled from one side. This makes it easier to set up and connect formwork elements, with the result that labor costs can be reduced.

According to a preferred embodiment, the formwork anchor receptacle has an internal thread in at least a section of the opening. The formwork anchor receptacle can be detachably connected to an anchor rod via this thread.

Furthermore, a locking means, particularly two holders, can be inserted into the formwork anchor receptacle and locked in place there, particularly by a resilient fixing means, to interlock an anchor rod with the formwork anchor receptacle. This allows easy handling.

According to another embodiment, the locking means has grooves engaging into grooves of the anchor rod. The locking means can thus be quickly and safely connected to the anchor rod.

In another embodiment, a sealing member is received in the opening on an end portion of the spherical section. This avoids leakage of the fill material introduced between formwork elements.

Furthermore, the present invention relates to a formwork anchor with an anchor rod, a first formwork receptacle as well as a second formwork anchor receptacle. The formwork anchor receptacles each comprise a preferably cylindrical section with an opening for insertion of the anchor rod, as well as a spherical section for providing support against a formwork element. The first formwork anchor receptacle can be attached to a first end of the formwork anchor and the second formwork anchor receptacle can be attached to a second end of the formwork anchor. As regards the advantages of the formwork anchor receptacles for the aforementioned formwork anchor, reference is made to be above statements.

Since these elements make it possible, when used with a formwork element, to provide the anchoring in the center, the concrete is given an attractive look. Due to this centered anchoring, the system moreover has no unused anchor holes. This leads to savings in time and avoids on-site operational errors.

Since the anchor rod is preferably conically shaped, the use of sheaths which would otherwise be required in the stripping process can be dispensed with.

In a preferred embodiment of the formwork anchor, the anchor rod comprises a screw-in limiting means at that end to which the second formwork anchor receptacle is attached, in addition to designs of the first and second formwork anchor receptacles already mentioned above.

In the region of the end to which the first formwork anchor receptacle is attached, the anchor rod preferably has openings for inserting therethrough a locking mechanism for interlocking the anchor rod with the first formwork anchor receptacle.

Furthermore, the present invention is directed at a formwork element according to claim 14. Particularly in the event of high formwork elements, an additional worker is not required on the access side during installation of the formwork anchor. It is even possible to dispense with intermediate platforms on the side assembled first. Furthermore, it is possible not only to generally reduce the number of formwork anchors, but also to save anchor points, particularly in the event of height-increased formwork.

Since anchor points are preferably centrally arranged on the formwork element, it is avoided that the formwork anchor might collide with the joint tape or other means for sealing the joint when the formwork elements are used in the region of the foundations.

DETAILED DESCRIPTION OF PREFERRED EMBODIMENTS

Preferred embodiments of the invention will now be explained in detail. Further modifications and variations of individual elements and components that are mentioned in this connection may in each case be combined with each other to form new embodiments.

Figure 1:
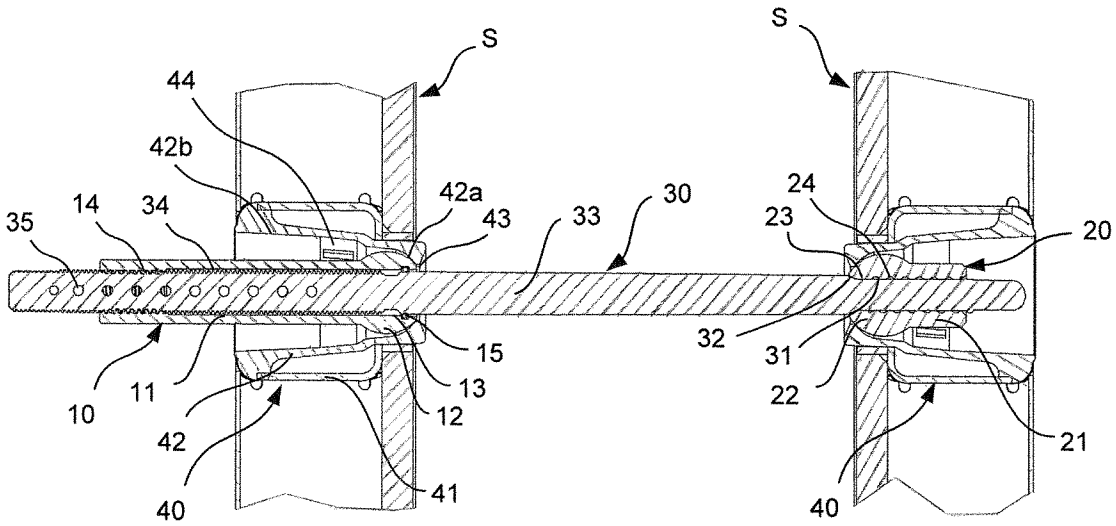
FIG. 1 is a sectional view of a formwork anchor and of the formwork elements connected therewith which make use of formwork anchor receptacles of the formwork anchor according to a first embodiment of the present invention.

FIG. 1 shows two formwork elements S with a fill area formed therebetween. A formwork anchor comprising an anchor rod 30, a first formwork anchor receptacle 10 as well as a second formwork anchor receptacle 20 is provided to interconnect the formwork elements S.

In the installed condition, the first formwork anchor receptacle 10 is attached to an end of the anchor rod 30 and supported against a support component 40 attached to the formwork wall S. The second formwork anchor receptacle 20 is disposed on the opposite end of the anchor rod 30 and supported on a support component 40 of the respective other formwork wall S.

The support components 40 provided on the formwork elements S are designed to be capable of receiving elements or sections of a formwork anchor. The support components thereby preferably have substantially the same design, such that the anchor rod 30 with the first formwork anchor receptacle 10 and the second formwork anchor receptacle 20 may also have an orientation other than that shown in FIG. 1.

The anchor rod 30, which extends from one formwork element to the next in FIG. 1, comprises at a first end an external thread 31 with a screw-in limiting means 32 which ensures a defined position of the second formwork anchor receptacle 20 relative to the anchor rod 30 when the former is fully screwed in. The external thread 31 is adjoined by a conical section 33 which, when installed, comes into contact with the fill material that is placed between the formwork elements S, e.g. concrete. Since the section 33 is conically designed, the anchor rod 30 can be removed from the hardened fill material.

That section of the conical section 33 of the anchor rod 30 that is opposite to the external thread 31 is adjoined by a further external thread 34 (particularly a trapezoidal thread) which has a smaller thread pitch than the external thread 31. Furthermore, openings 35 are provided in the region of the further external thread 34, through which a locking mechanism can be inserted to fix the anchor rod 30 to the first formwork anchor receptacle 10.

The second formwork anchor receptacle 20, which is provided in the region of the external thread 31 of the anchor rod 30, comprises a substantially cylindrical section 21 as well as a spherical section 22. The spherical section 22 forms a spherical curve. An opening 23 extends through the formwork anchor receptacle 20 along the center axis of the cylindrical section 21. Portions of the opening 23 of the formwork anchor receptacle 20 are provided with an internal thread 24 which engages into the external thread 31 of the anchor rod 30.

The described type of screw fastening offers the advantage that the fasteners will not leave any marks in the hardened fill material, which thus gives the concrete an attractive look.

The first formwork anchor receptacle 10 has a first end and a second end. A cylindrical section 11 extends between the first end and the second end, said cylindrical section being designed longer than the cylindrical section 21 of the second formwork anchor receptacle 20 since the cylindrical section 11 of the first formwork anchor receptacle 10 additionally serves to permit adjustment between the anchor rod 30 and the formwork anchor receptacle 10. In this way, the formwork anchor can be adapted to different distances between the formwork elements, as will be explained in detail in the following.

The first formwork anchor receptacle 10 further comprises a spherical section 12 which adjoins the cylindrical section 11 and which forms a spherical outer curve just as the spherical section 22 of the second formwork anchor receptacle 20. The outer shapes of the spherical sections 12, 22 substantially match each other here, and therefore—as already mentioned—the anchor rod 30 with the formwork anchor receptacles 10, 20 can also be connected to the formwork elements S when oriented differently.

An opening 13 extends along the center axis of the cylindrical section 11 of the first formwork anchor receptacle 10. Through this opening 13, the anchor rod 30 can be inserted into the formwork anchor receptacle 10 and engage with an internal thread 14 of the formwork anchor receptacle 10. This internal thread 14 is provided in the region of the opening 13 at an end of the formwork anchor receptacle 10 that is opposite to the spherical section 12.

At least one support component 40 is attached to each formwork element S. The number of support components 40 may vary depending on the size of the formwork element S, in order to provide a safe connection between different formwork elements S. Since the support components 40 on the left-hand and right-hand formwork elements 40 preferably have substantially the same design in the embodiment shown in FIG. 1, only one of the support components is identified by a reference numeral.

The support component 40 comprises an attachment section 41 that is fixedly connected to the formwork element S in the present embodiment shown in FIG. 1. For example, the support component 40 can be welded to the formwork element S.

Furthermore, the support component 40 includes a receiving and supporting section 42 comprising a spherically designed ball socket 42*a* as well as a receiving zone 42*b*. In the region of the ball socket 42*a*, which preferably has an opening 43 in its center to pass through the anchor rod 30, the formwork anchor receptacle 10 is received in the region of the spherical section 12 when formwork elements S are connected together by the anchor rod 30. The design of the ball socket 42*a* ensures that there is abutment of the first formwork anchor receptacle 10 (or the second formwork anchor receptacle 20), thus preventing leakage of the material filled between the formwork elements S. The spherically designed ball socket 42*a* is thereby provided in the region of the inner wall of the formwork element S such that the spherical section 12 (or 22) abuts as closely as possible the fill area between the formwork elements S.

The support component 40 furthermore comprises holding means—in this embodiment a mount 44—removably installed in the receiving zone 42*b* to attach the respective formwork anchor receptacle 10, 20.

The formwork shown in FIG. 1 is assembled as follows.

First, the formwork elements S are erected in spaced-apart relation, and the anchor rod 30, comprising the first formwork anchor receptacle 10, is inserted (from left to right in FIG. 1) through one of the support components 40, with the formwork anchor receptacle 20 being already provided in the corresponding right-hand formwork element shown in FIG. 1. The anchor rod 30, comprising the formwork anchor receptacle 10, is inserted (from left to right in FIG. 1) through the support component 40 of the formwork element 11 shown on the left in FIG. 1. The anchor rod 30 thereby passes section by section through the support component 40 of the further formwork element 5 and is attached there.

After the material filled between the formwork elements S has hardened, the anchor rod 30 is disengaged on the side of the first formwork anchor receptacle 10 by counterclockwise rotation. Owing to the different thread pitches between the first formwork anchor receptacle 10 and the second formwork anchor receptacle 20, this rotation gives rise to relative motion between these elements.

The second formwork anchor receptacle 20 is then disengaged from the anchor rod 30, and the anchor rod 30 with the formwork anchor receptacle 10 fastened thereto is removed after the holding means 44 has been disengaged.

Figure 2:
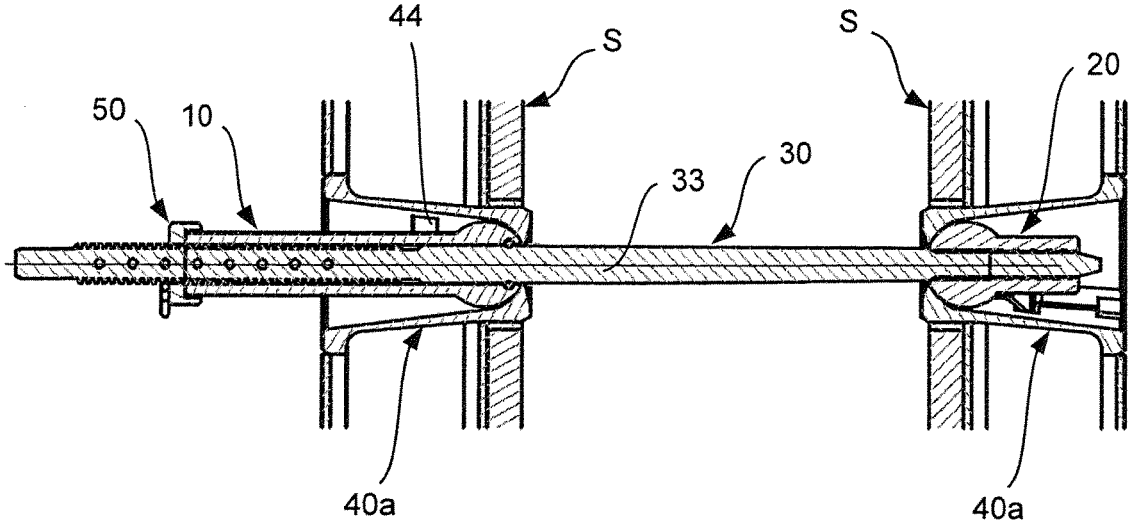
FIG. 2 is a sectional view of a formwork anchor and of two formwork elements according to a second embodiment of the present invention.

The arrangement shown in FIG. 2 substantially corresponds to that of FIG. 1. However, the support components 40*a* that are used to receive the formwork anchor receptacles 10, 20 are designed differently. The support components 40*a* are cup-shaped and have a radius in the region in which the respective spherical section abuts.

In the embodiment shown in FIG. 2, an anti-rotation device 50 is additionally provided to lock the anchor rod 30 on the first formwork anchor receptacle 10. This anti-rotation device 50 is fitted onto the anchor rod 30 after insertion of a locking member through the first formwork anchor receptacle 10 and one of the openings 35 of the anchor rod 30.

In the structure shown in FIGS. 1 and 2, the support components 40, 40*a* are each designed such that the formwork elements S can be stacked one on top of the other. This is ensured in that the section components 40, 40*a* substantially do not project beyond the plane of the formwork element.

Figure 3:
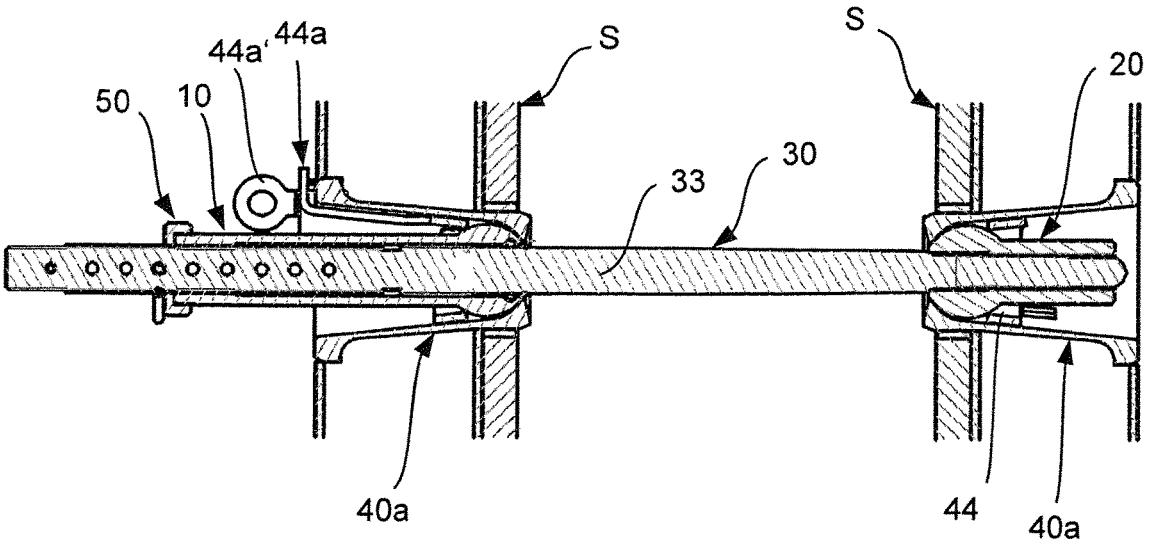
FIG. 3 is a sectional view of a formwork anchor and of two formwork elements according to a third embodiment of the present invention.

FIG. 3 shows an alternative embodiment of a mount 44*a* in the region of the first formwork anchor receptacle 10, with which the formwork anchor receptacle 10 is prevented from protruding or turning relative to the section component 40*a*. The mount 44*a* thereby comprises a fixing means 44*a'* protruding beyond the plane of the formwork element S. It is possible with the fixing means 44*a'* to fasten the mount 44*a* to the support component 40*a* and to remove it therefrom in a relatively simple manner as required. The mount 44, which is provided in the region of the second formwork anchor receptacle 20, does not include additional fixing means.

It is apparent from the combination of the mounts 44*a*, 44 that these can be employed in accordance with the specific use and can be freely combined with the remaining components.

Figure 4:
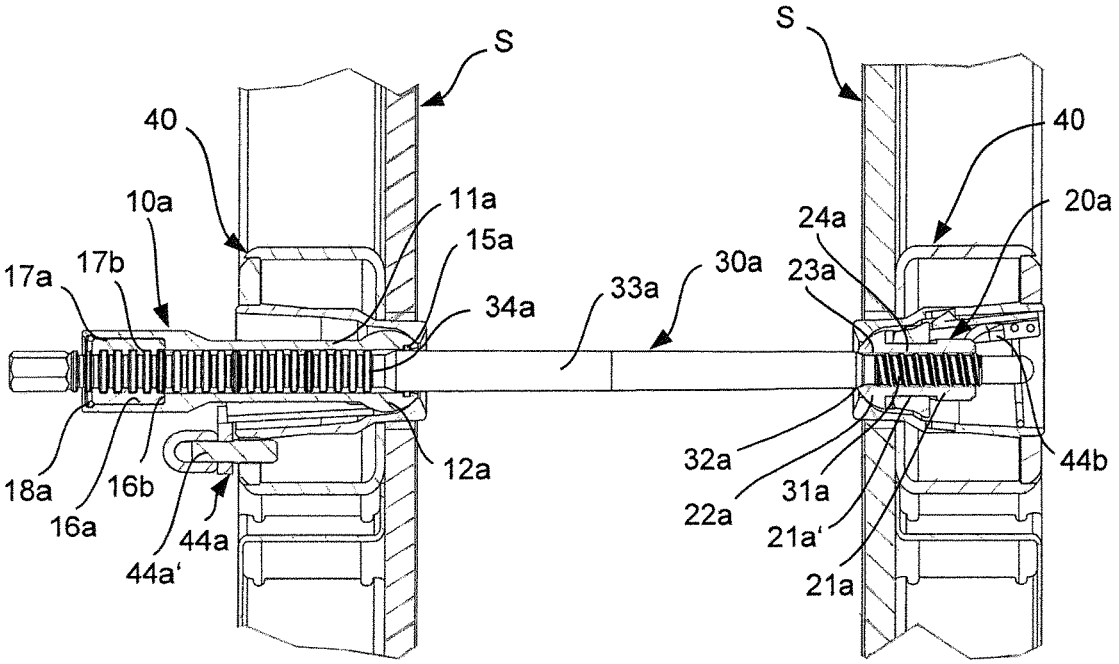
FIG. 4 is a sectional view of a formwork anchor and of two formwork elements according to a fourth embodiment of the present invention.

FIG. 4 relates to a further embodiment of the present invention. Instead of the external thread 34 used in the first embodiment, circumferential grooves or recesses 34*a* having a rectangular or trapezoidal cross-section are provided on the anchor rod 30*a* in the region of the first formwork anchor receptacle 10*a*. Several of these grooves are provided with markings which serve as some kind of rough guide in adjusting the length of the formwork anchor.

An opening 16*a* is provided in the section of the first formwork anchor receptacle 10*a* that is opposite to the spherical section 12*a*. Two half-shell holders 17*a* are inserted into this opening 16*a* together with the anchor rod 30*a*. Since the half-shell holders 17*a* have grooves 17*b* on their inner side, which engage into the grooves 34*a* of the anchor rod 30*a*, the half-shell holders 17*a* are fixedly connected to the anchor rod 30*a* after insertion into the opening 16*a*. While inserted, the half-shell holders 17*a* come up against a protrusion 16*b* in the opening 16*a*. From this protrusion 16*b* onwards, there is provided an opening 13*a* with a smaller diameter than in the region of the opening 16*a*.

Furthermore, a resilient connecting means 18*a* (fixing spring ring) is incorporated in the opening 16*a* in the end portion thereof such that half-shell holders 17*a* are pressed against the protrusion 16*b* and are thus interlocked with the first formwork anchor receptacle 10*a*.

In the embodiment shown in FIG. 4, the second formwork anchor receptacle 20*a* is designed with a substantially cylindrical section 21*a* as well as with a spherical section 22*a*. However, a recess 21*a'* is provided in the region of the cylindrical section 21*a*, into which a mount 44*b* can penetrate. Just as in the first embodiment, the second formwork anchor receptacle 20*a* further comprises an opening 23*a* with an internal thread 24*a*.

The anchor rod 30*a* is designed in substantially the same manner in the region of the second formwork anchor receptacle 20*a* as in the first embodiment. Due to the use of a one-sided thread in the region of the formwork anchor receptacle 20*a*, the process of erecting and dismantling the formwork can be further sped up.

Figure 5A:
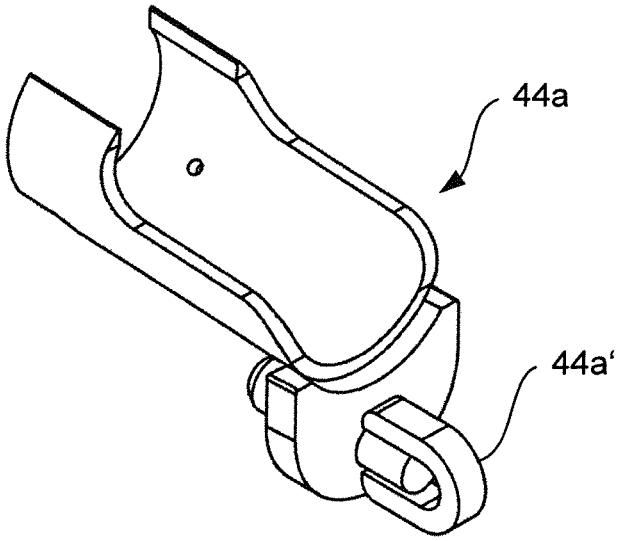
FIG. 5*a* is a perspective view of a holding means for a formwork anchor used in FIG. 4.

FIG. 5*a* shows an embodiment of a mount 44*a* (disposed on the left in FIG. 4), which is inserted into the receiving region 42*b* of the support component 40 in order to fix the first or second formwork anchor receptacle in the support component. The mount 44*a* can thereby be screwed together with the formwork element S via a fixing means 44*a'*.

Figure 5B:
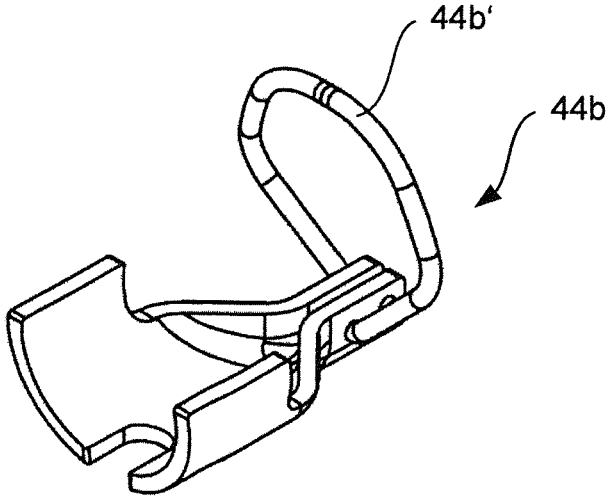
FIG. 5*b* is a perspective view of an alternative holding means for a formwork anchor used in FIG. 4.
Figure 6:
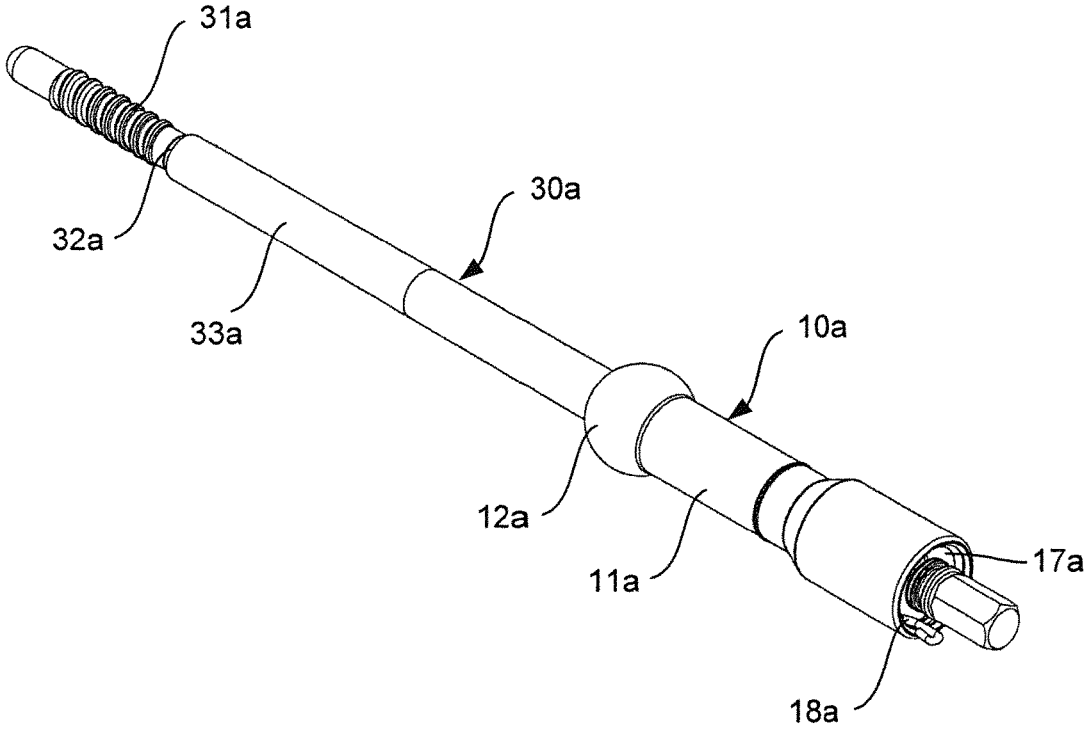
FIG. 6 is a perspective view of the formwork anchor with formwork anchor receptacle shown in FIG. 4.

FIG. 5*b* shows another embodiment of a mount 44*b* (disposed on the right in FIG. 4) for fixing a formwork anchor receptacle, preferably the second formwork anchor receptacle 20, 20*a*, in the support component. A folding spring 44*b'*, which in the functional state is placed against the inner wall of the ball socket, is thereby used to fix the position. In this way, the recesses and nibs are moved into the corresponding counter-deformations in the ball socket, i.e. their functional position as retaining and anti-rotation devices.

The integrated locking system with the mounts 44, 44*a*, 44*b* offers flexible connection options.

The invention claimed is:

1. A formwork anchor with an anchor rod and a first formwork anchor receptacle as well as with a second formwork anchor receptacle, wherein said formwork anchor receptacles each comprise a cylindrical section with an opening for insertion of the anchor rod, as well as a spherical section, the spherical section has a convex-curved outer surface, wherein the formwork anchor has an external thread on another end section of the anchor rod, wherein the first formwork anchor receptacle can be attached to a first end of the anchor rod and the second formwork anchor receptacle can be attached to a second end of the anchor rod, wherein the second formwork anchor receptacle has an internal thread in at least a section of the opening, which has a pitch other than that of an internal thread of the first formwork anchor receptacle.

2. The formwork anchor according to claim 1, wherein a locking means, particularly two holders, can be inserted into the first formwork anchor receptacle and fixed there, particularly by a resilient fixing means, to interlock an anchor rod with the formwork anchor receptacle.

3. The formwork anchor receptacle according to claim 2, wherein the locking means has grooves engaging into grooves of the anchor rod.

4. The formwork anchor according to claim 1, wherein a sealing member is received in the opening on an end portion of the spherical section of the first formwork anchor receptacle.

5. The formwork anchor according to claim 1, wherein the anchor rod has a screw-in limiting means at that end to which the second formwork anchor receptacle is attached.

6. A formwork system comprising:

a formwork element;

a support component; and a formwork anchor receptacle, the formwork anchor receptacle comprising a section with an opening for insertion of an anchor rod, wherein the formwork anchor receptacle comprises a spherical section for providing support against the formwork element, the spherical section having a convex-curved outer surface, said support component comprising a ball socket having a concave surface for receiving the spherical section of the formwork anchor receptacle having the convex shape, the concave surface of the ball socket facing the spherical section, the ball socket positioned adjacent an inner wall region of the formwork element.

7. The formwork system according to claim 6, wherein a holding means can be inserted into the support component to attach the respective formwork anchor receptacle.

8. The formwork system according to claim 6, wherein a further opening is provided in a section of the formwork anchor receptacle that is opposite to the spherical section.

9. The formwork system according to claim 8, wherein a locking means comes up against a protrusion in the further opening when the locking means is inserted into the formwork anchor receptacle.

10. The formwork system according to claim 9, wherein from the protrusion onwards towards the spherical section, the opening has a smaller diameter than the further opening on a side of the protrusion opposite the spherical section.

11. The formwork system according to claim 6, wherein an anchor rod is interlocked with the formwork anchor receptacle by a locking means.

12. The formwork system according to claim 6, wherein a locking means can be inserted into the first formwork anchor receptacle and fixed by a resilient fixing means to interlock an anchor rod with the formwork anchor receptacle.

13. The formwork system according to claim 12, wherein the locking means has grooves engaging into grooves of the anchor rod.

14. The formwork system according to claim 6, wherein a sealing member is received in the opening on an end portion of the spherical section of the formwork anchor receptacle.

15. A formwork system comprising:

a formwork element;

a support component;

a sealing member; and a formwork anchor receptacle, the formwork anchor receptacle comprising a section with an opening for insertion of an anchor rod, wherein the formwork anchor receptacle comprises a spherical section for providing support against the formwork element, the spherical section having a convex-curved outer surface, said support component comprising a ball socket having a concave surface for receiving the spherical section of the formwork anchor receptacle having the convex shape, the concave surface of the ball socket facing the spherical section, the ball socket disposed on the formwork element and the sealing member is received in the opening on an end portion of the spherical section of the formwork anchor receptacle.

16. The formwork system according to claim 15, wherein a holding means can be inserted into the support component to attach the respective formwork anchor receptacle.

17. The formwork system according to claim 15, wherein a further opening is provided in a section of the formwork anchor receptacle that is opposite to the spherical section.

18. The formwork system according to claim 17, wherein a locking means comes up against a protrusion in the further opening when the locking means is inserted into the formwork anchor receptacle.

19. The formwork system according to claim 18, wherein from the protrusion onwards towards the spherical section, the opening has a smaller diameter than the further opening on a side of the protrusion opposite the spherical section.

20. The formwork system according to claim 15, wherein an anchor rod is interlocked with the formwork anchor receptacle by a locking means.

21. The formwork system according to claim 15, wherein a locking means can be inserted into the first formwork anchor receptacle and fixed by a resilient fixing means to interlock an anchor rod with the formwork anchor receptacle.

22. The formwork system according to claim 21, wherein the locking means has grooves engaging into grooves of the anchor rod.

23. The formwork system according to claim 15, wherein a sealing member is received in the opening on an end portion of the spherical section of the formwork anchor receptacle.

* * * * *